US008066217B2

(12) United States Patent
Cittadino et al.

(10) Patent No.: US 8,066,217 B2
(45) Date of Patent: Nov. 29, 2011

(54) DISPENSER AND DISPENSING METHOD HAVING COMMUNICATION ABILITIES

(75) Inventors: Antonio M. Cittadino, Appleton, WI (US); J. Daniel Silk, Sandy Springs, GA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 60 days.

(21) Appl. No.: 12/251,976

(22) Filed: Oct. 15, 2008

(65) Prior Publication Data

US 2009/0101751 A1 Apr. 23, 2009

Related U.S. Application Data

(60) Provisional application No. 60/981,743, filed on Oct. 22, 2007.

(51) Int. Cl.
*B65H 43/00* (2006.01)

(52) U.S. Cl. ..... 242/563; 242/564.1

(58) Field of Classification Search ..... 242/563, 242/563.2, 564, 564.1, 565; 250/221
See application file for complete search history.

(56) References Cited

U.S. PATENT DOCUMENTS 4,972,070 A * 11/1990 Laverty, Jr. ..... 250/221
5,097,981 A * 3/1992 Degasperi et al. ..... 221/3
5,202,666 A 4/1993 Knippscheer
5,945,910 A 8/1999 Gorra
6,392,546 B1 5/2002 Smith
6,426,701 B1 7/2002 Levy et al.
6,578,728 B1 * 6/2003 Weigen ..... 221/2
6,592,067 B2 7/2003 Denen et al.
6,690,275 B2 * 2/2004 Long et al. ..... 340/525
6,695,246 B1 * 2/2004 Elliott et al. ..... 242/564.1
6,727,818 B1 4/2004 Wildman et al.
6,793,170 B2 9/2004 Denen et al.
6,838,887 B2 1/2005 Denen et al.
6,871,815 B2 3/2005 Moody et al.
6,882,278 B2 4/2005 Winings et al.
6,970,574 B1 11/2005 Johnson
6,975,231 B2 12/2005 Lane et al.
7,017,856 B2 3/2006 Moody et al.
7,102,366 B2 9/2006 Denen et al.
7,161,359 B2 1/2007 Denen et al.
7,182,288 B2 2/2007 Denen et al.
7,182,289 B2 2/2007 Moody et al.
7,242,307 B1 7/2007 LeBlond et al.
7,271,728 B2 9/2007 Taylor et al.
7,523,885 B2 * 4/2009 Lewis ..... 242/563
7,774,096 B2 * 8/2010 Goerg et al. ..... 700/236
2003/0030562 A1 2/2003 Lane et al.
2003/0213809 A1 * 11/2003 Weigen ..... 221/2
(Continued)

OTHER PUBLICATIONS

"Hand Hygiene Voice Module", Kimberly-Clark Professional, Kimberly-Clark Worldwide, Jun. 2006, 2 pages, http://www.kcprofessional.com/us/product-details.asp?prd_id=09123 (accessed Oct. 13, 2008).

*Primary Examiner* — William A Rivera

(57) ABSTRACT

Dispensers and dispensing systems and methods having communication abilities are provided. Various embodiments include the ability to communicate reminders and other messages to users and maintenance personnel. An embodiment of the present invention has two sensors, one for detecting when to dispense a product and the other for detecting when to communicate pre-recorded messages. Another embodiment also includes the ability to record multiple messages into the dispenser for later playback upon triggering events. Still yet other embodiments provide messages upon dispensing of product.

13 Claims, 8 Drawing Sheets

U.S. PATENT DOCUMENTS

2005/0145745 A1* 7/2005 Lewis et al. ..... 242/563
2006/0173576 A1* 8/2006 Goerg et al. ..... 700/236
2007/0029435 A1 2/2007 Moody et al.
2007/0194166 A1* 8/2007 Reinsel et al. ..... 242/563
2008/0021779 A1 1/2008 Lynn et al.
2008/0087719 A1 4/2008 Sahud
2008/0100185 A1* 5/2008 Lewis ..... 312/34.22

* cited by examiner

DISPENSER AND DISPENSING METHOD HAVING COMMUNICATION ABILITIES

CROSS-REFERENCE TO PRIOR APPLICATION

This application claims the benefit of the filing date of Oct. 22, 2007 to U.S. Provisional Patent Application 60/981,743 which is incorporated by reference in its entirety.

BACKGROUND OF THE INVENTION

The present disclosure generally relates to dispensers and dispensing systems and, more particularly, to dispensers and dispensing systems and methods having communication abilities, including communicating reminders and other messages to users and maintenance personnel.

Electronic hands-free dispensers dispense a metered amount of some product, such as a sheet product for example, without physical contact from a human being. This makes it unnecessary for a user to physically touch a knob or a lever to receive the product. Typically, a proximity sensor having a sensing field enables hands-free operation. Insertion of an object, such as the user's hand for example, into the field modifies the properties that the proximity sensor senses, and in turn, this is used to operate the dispenser. Typically, deployment of hands-free dispensers tends to increase use of the dispensers because users are not required to physically touch the dispenser.

To also increase hand washing of restroom users, some operators are deploying stand-alone voice modules in restrooms to remind users to wash their hands. The stand-alone voice module unit is typically positioned in restrooms near the sink area. The voice module constantly reminds people to wash their hands and operates on a fixed time routine. Studies have demonstrated that users, if reminded, will wash their hands more often.

While the voice module is successful in increasing the number of users who wash their hands, battery issues are encountered. Since the reminder runs on a continuous playback loop instead of being triggered by an event, the voice module continuously operates. This results in a strain on the voice module's battery thereby requiring continuous maintenance and battery replacement. Also, existing stand-alone voice modules typically only have the ability to play a single reminder and not store multiple messages.

Thus, while existing restroom communications systems are suitable for their intended purposes, there remains a need for improvements. In particular, there remains a need for improvements in reducing the amount of energy required for operation and the ability to communicate different messages over time.

SUMMARY OF THE INVENTION

A dispenser is provided having a controller and a first sensor electrically coupled to the controller. A dispenser mechanism is operably coupled to the first sensor. The dispenser mechanism dispenses a product in response to a signal from the first sensor. A second sensor is also electrically coupled to the controller. A speaker is operably coupled to the second sensor and the controller, wherein the speaker emits a prerecorded audible message in response to the controller receiving a signal from the second senor sensor.

A dispenser is also provided having a housing with a dispensing area. A first sensor is coupled to the housing adjacent the dispensing area. A dispenser mechanism is arranged to dispense a product from the dispensing area. The dispenser mechanism is operably coupled to the first sensor such that when the first sensor is activated, the dispenser mechanism dispenses the product from the dispensing area. A second sensor is coupled to the housing. A speaker is operably coupled to the second sensor, wherein the speaker emits a prerecorded audible message when the second sensor is activated.

A method of operating a dispenser is also provided. The method includes the step of activating a recording mode. A recording button is actuated. An audio message is recorded. A play mode is activated. The recorded audio message is played in response to an activation of a first sensor. Finally, a product is dispensed in response to an activation of a second sensor.

DETAILED DESCRIPTION

Figure 1:
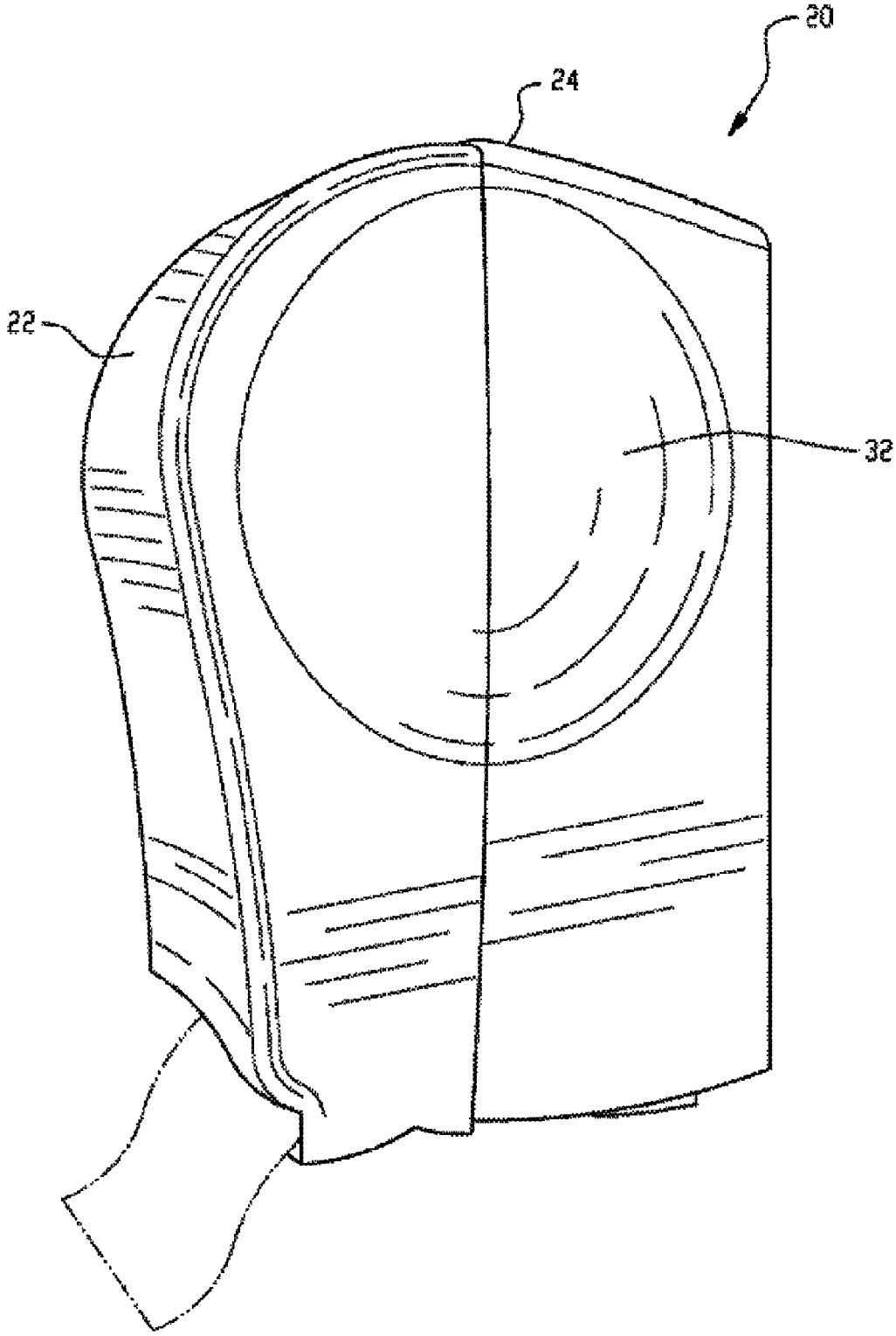
FIG. 1 is a side plan view illustration of a dispenser with the cover closed in accordance with one embodiment of the invention.
Figure 2:
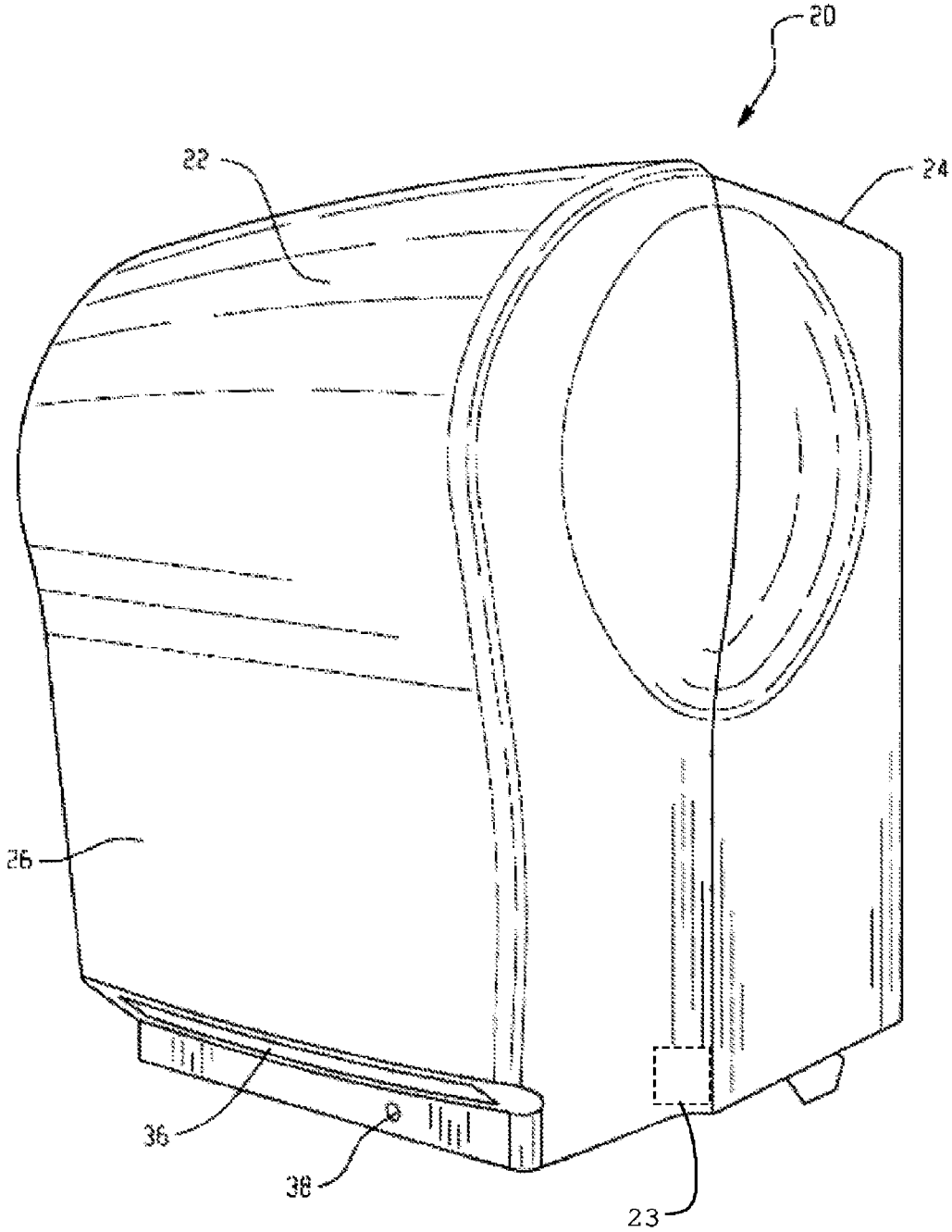
FIG. 2 is a perspective view illustration of the dispenser of FIG. 1.
Figure 3:
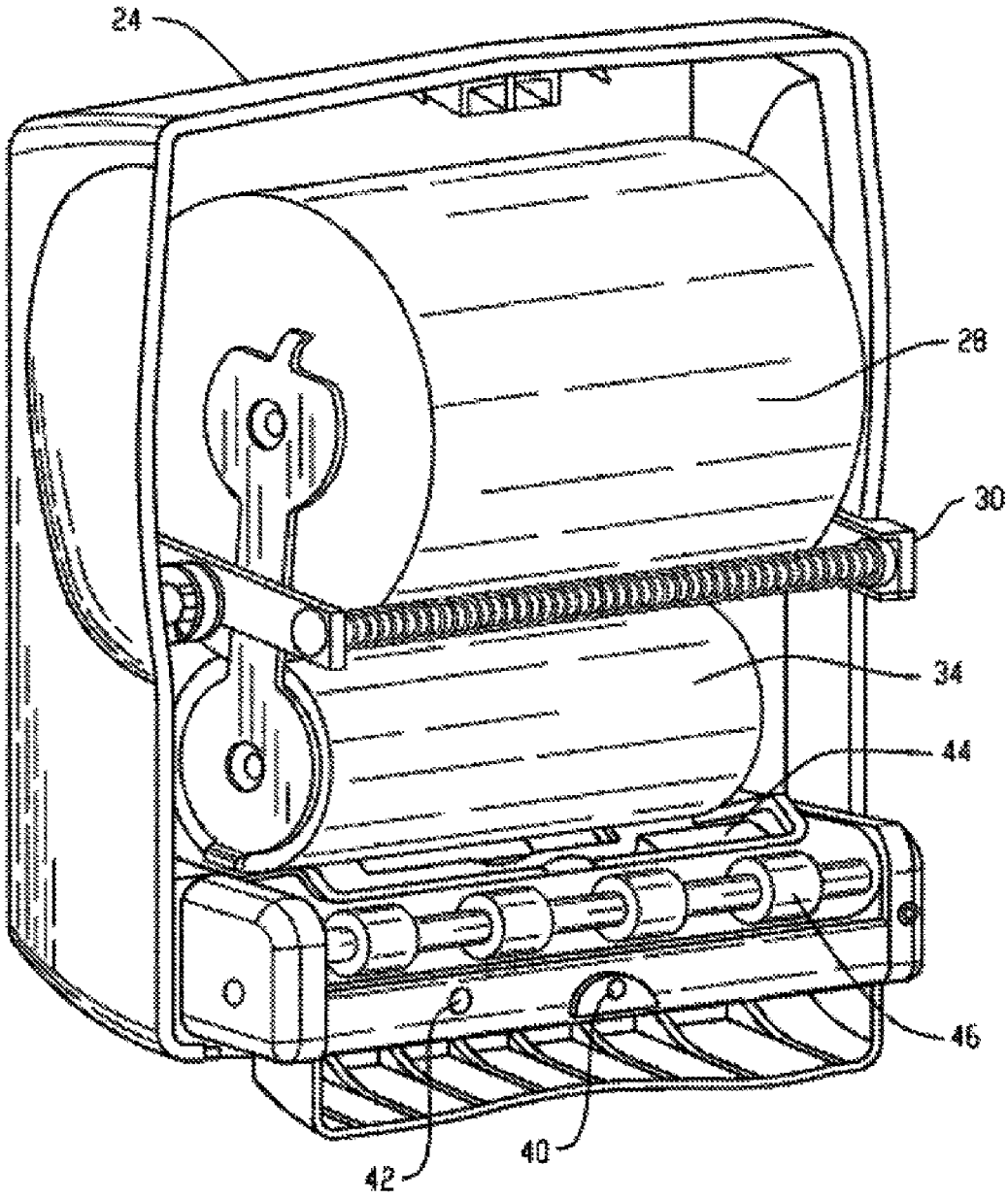
FIG. 3 is a perspective view illustration of the dispenser of FIG. 1 with the cover removed.

FIGS. 1-3 illustrate an exemplary embodiment of a dispenser 20. The dispenser 20 may be any type of dispenser that provides a product when activated by a user. As such, the dispenser 20 may be a soap dispenser, a liquid soap dispenser, a foam dispenser or a sheet product dispenser for example. While reference may be made to soap or liquid soap, it will be appreciated that the scope of the invention is not so limited, and extends to other flowable products, such as liquid, foam, gel, lotion, detergent, or any other flowable product capable of being pumped from a dispenser, for example. Further, the term "sheet products" as used herein is inclusive of natural and/or synthetic cloth or paper sheets. Sheet products may include both woven and non-woven articles. There are a wide variety of non-woven processes and they can be either wetlaid or drylaid. Some examples include hydroentagled (sometimes called spunlace), double re-creped (DRC), airlaid, spunbond, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

Various embodiments of the present invention include various types of dispensers, including, but not limited to, paper towel, napkin, soap, scent, and tissue. The present invention encompasses any dispenser having communication abilities, including hands-free dispensers having communication abilities. Embodiments of the present invention may be standalone or may be part of a network for ease of storing messages in the dispenser. Further, the following US Patents and US Patent Application Publications are owned by the Assignee of the present application, and are hereby incorporated by reference as if fully set forth herein: U.S. Pat. Nos. 6,592,067, 6,793,170, 6,838,887, 6,871,815, 7,017,856, 7,102,366, 7,161,359, 7,182,288, 7,182,289, and 2007/0029435. Certain embodiments of the present invention include features recited within the incorporated patents and patent applications.

The dispenser 20 includes a front cover 22 and a back-housing 24 that are arranged to hold and dispense a product 28, 34. In one embodiment, the cover 22 is coupled to the back-housing 24 by a hinge that allows the cover 22 to be rotated away from the back-housing 24. This allows the operator access to the internal areas of the dispenser 20 for performing maintenance tasks, such as refilling the supply of product for example. Once the operator has completed the desired tasks, the cover 22 is rotated until it re-engages the back-housing 24.

In an embodiment the dispenser 20 includes an upper circular bulge 32, providing room for a full roll of paper towel 28, installed in the upper position of a dispenser mechanism 30. The shape of the dispenser 20 is such that the front cover tapers inwardly 26 towards the bottom to provide a smaller dispenser volume at the bottom where there is a smaller stub roll of paper towel 34. The shape tends to minimize the overall size of the dispenser 20.

The taper 26 configuration also tends to visually guide a user's hand toward a dispensing slot 36, leading to activation of the proximity sensor 38. A light emitting diode (LED) 40 is located centrally to the dispensing slot 36. The LED 40 serves as an indication that the dispenser 20 is on, and dispensing sheet product. The LED 40 may be off while the dispenser is not dispensing. Alternatively, the LED 40 may be lit (on), and when the dispenser 20 is operating, the LED 40 may flash. The LED 40 might show green when the dispenser 20 is ready to dispense, and flashing green, or orange, when the dispenser 20 is operating to dispense. Any combination may be used. The least power consumption is where the LED 40 only lights during a dispensing duty cycle. The taper 26 also allows a hand to come more closely to the proximity sensor 38.

The dispenser 20 includes a second proximity sensor 42 and a recording module 44. The second proximity sensor 42 and recording module 44 can be positioned in various locations relative to a dispenser 20 in accordance with embodiments of the present invention. For example, the second proximity sensor 42 can be co-located with the proximity sensor 38 on, or within, the dispenser 20. Alternatively, the second proximity sensor 42 can be located externally or remotely from the dispenser and operatively coupled to the dispenser 20. Similarly, the recording module 44 may be located within the dispenser 20 or located externally from the dispenser 20.

The recording module 44 can operate in several operating modes and can include a memory to hold one or more messages. The messages can be audio, video, or a combination of both. One operating mode is a recording mode and another is a playback mode. In the recording mode, the recording module 44 is used to store one or more messages. In the playback mode, recording module 44 can play the store message to enable the dispenser 20 to have communication abilities. As will be discussed in more detail below, a switch may be used to change between operating modes.

The second proximity sensor 42 may also be used to control certain functions of the recording module 44. For example, when the second proximity sensor 42 senses something in its sensing field, the sensor 42 can assert a signal to initiate operation of the recording module 44 to emit an audible prerecorded message. It should be appreciated that the audible message may by either recorded at the dispenser 20, or be pre-programmed by the manufacturer on recording module 44. This advantageously enables the second proximity sensor 42 to operate the recording module 44 to provide a reminder message.

According to certain embodiments, the second proximity sensor 42 can have a sensing range different from the proximity sensor 38. For example, the second proximity sensor 42 can have a sensing range with more area than the proximity sensor 38. For example, the proximity sensor 38 may have a range of 3 to 12 inches (e.g. for detecting the users hands) while the second proximity sensor 42 may have a range of 3 to 10 feet (e.g. for detecting a user walking by). In the exemplary embodiment, the proximity sensor 38 has a range of 3 inches and the second proximity sensor has a range of 6 feet. It should be appreciated that any type of proximity sensor known in the art that is suitable for the intended ranges may be used for the proximity sensors 38, 42. By allowing the proximity sensors 38, 42 to have different ranges, different events can trigger the activation of the recording module 44, due to being controlled by the second proximity sensor 42, prior to dispensing of sheet product housed within the dispenser 20. This provides advantages in enabling one or more reminder messages to be provided to a user in an effort to remind a user to use the dispenser prior to dispensing of product.

Figure 4:
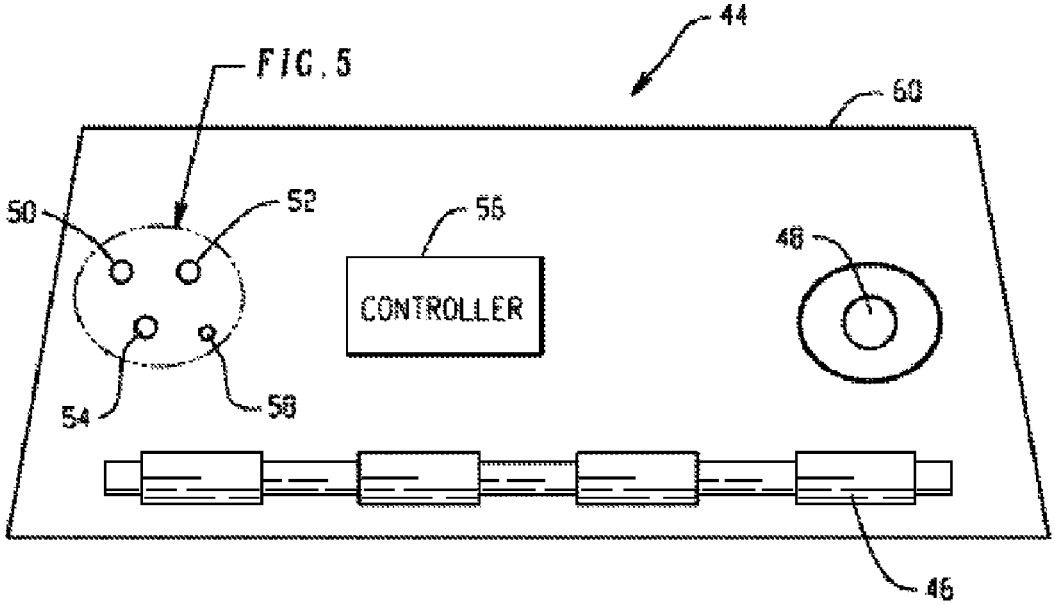
FIG. 4 is a partial perspective view illustration of a dispenser having a recording module in accordance with another embodiment of the invention.
Figure 5:
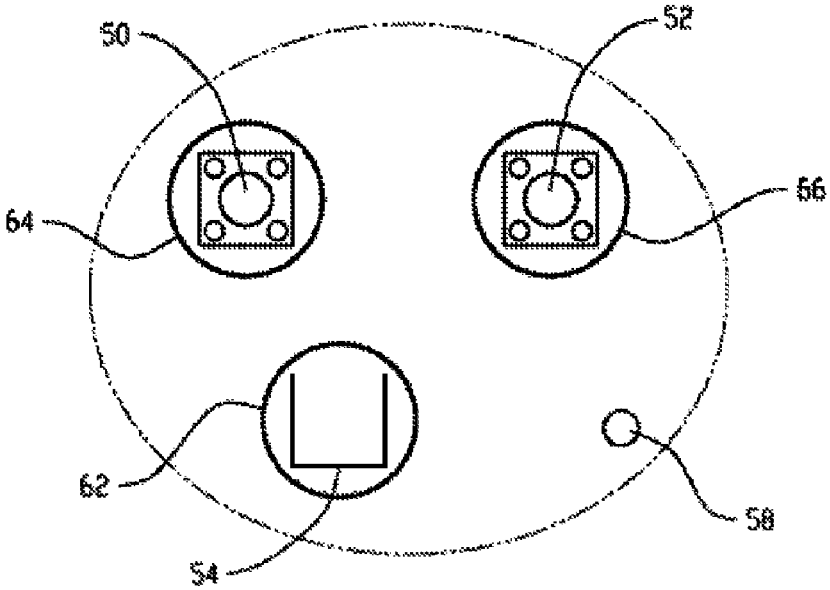
FIG. 5 is partial plan view illustration of the recording module controls of FIG. 4.
Figure 6:
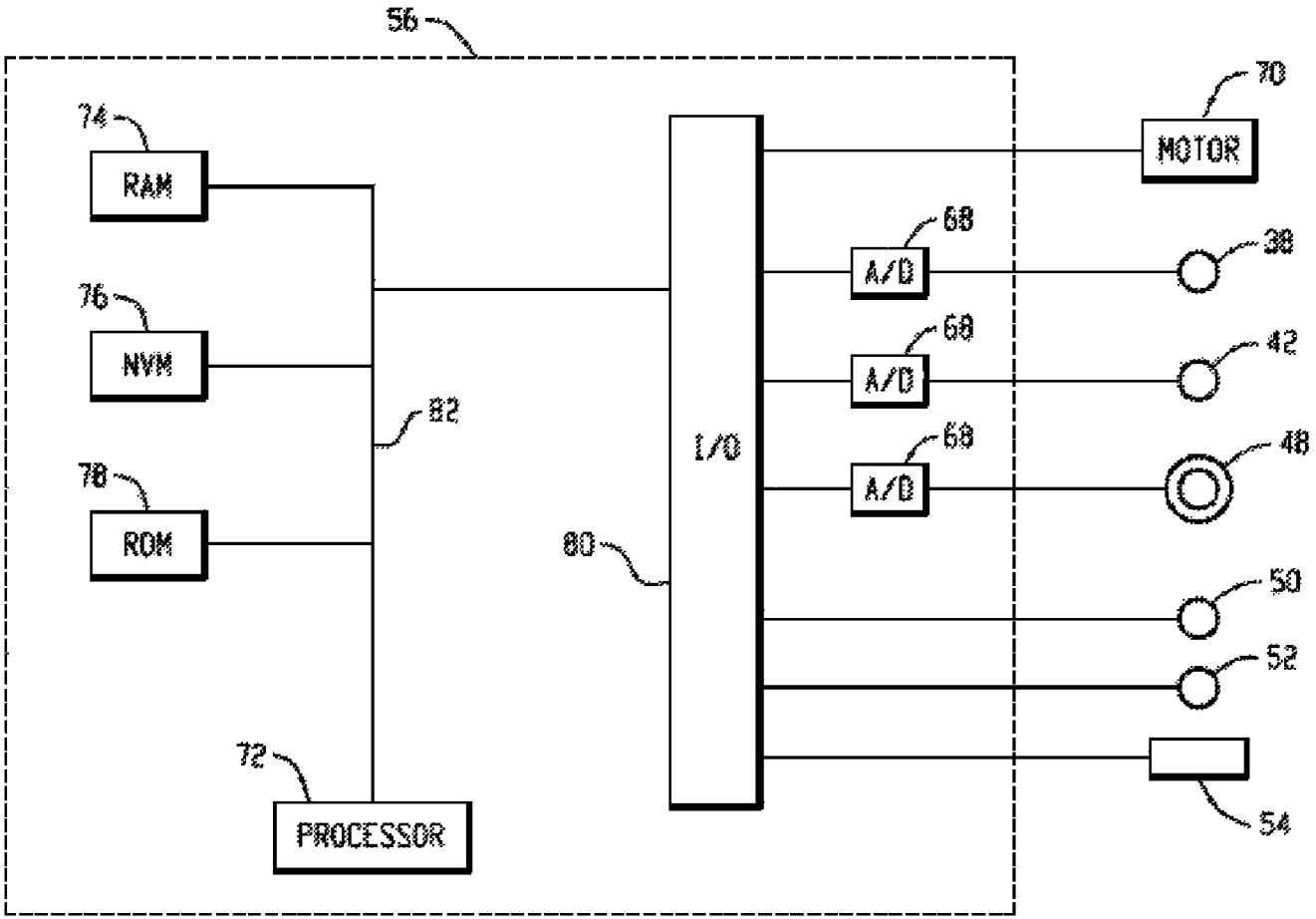
FIG. 6 is a schematic illustration of a controller for the recording module of FIG. 4.

In one embodiment, the recording module 44 is positioned in the back-housing 24 adjacent the dispensing rollers 46 as illustrated in FIGS. 4-6. It should be appreciated that by arranging the recording module 44 inside of the dispenser 20, tampering by unauthorized persons will be inhibited. This embodiment includes a speaker/microphone device 48, a recording button 50, a play button 52, and an activation switch 54 coupled to a controller 56. An optional LED 58 indicates when the recording function has been activated.

To operate the recording module 44, the operator removes the front cover 22. Using a small diameter tool, such as a pen for example, the operator actuates the switch 54 by inserting the tool into an opening 62 in the cover 60 of back-housing 24. This allows the tool to engage a sliding activation switch 54 which can be moved between a record position and a play position. Once the switch 54 has been moved to the record position, the operator once again uses a tool, such as a pen for example, and inserts the tool into an opening 64 to engage the record button 50. The activation of the record button 50 initiates a recording function on the controller 56. After holding the record button 50 for a brief period of time, such as one second for example, the controller 56 emits an audible tone, such as a beep, indicating to the operator that recording has begun. The optional LED 58 may also light once recording has begun. The operator then speaks into the speaker/microphone device 48. In one embodiment, the user has six seconds of recording time.

Once the operator has recorded their message, the operator can use the tool to activate the play button 52 by inserting the tool through the opening 66. Once the play button 52 has been activated, the controller 56 plays the recorded message back. If the operator is satisfied, they may use the tool to slide the activation switch 54 to the "play" position that activates the play mode. While in this position, the dispenser will play the recorded message each time the proximity sensor 42 is activated. If the operator does not desire to enable the communication ability, the switch 54 is left in the record mode position.

In some embodiments, the dispenser 20 may include features that allow the recording and playback of multiple messages. For example, the message may be recorded in multiple languages. The ability to play multiple languages may provide advantages in applications such as in international airports for example. The dispenser 20 may also provide context sensitive messages depending on which sensors are activated. Alternatively, the dispenser 20 may communicate with other devices (not shown) in the application such as a soap dispenser or a door opening mechanism. This communication would allow a context sensitive message, such as thanking the user if they follow proper a proper protocol by activating the soap dispenser and then activating the dispenser 20 for example. The dispenser 20 could then communicate with and a door opening mechanism to open the door as the user leaves.

In another embodiment, a sensor 23, such as a microswitch for example, may be coupled to interact with the cover 22. The sensor 23 is coupled to the controller 56 to allow the controller 56 to detect when the cover 22 is opened. In this embodiment, when maintenance personnel open the cover to access the product 28, a message may be played. This message may be used to notify the maintenance personnel on the status of the dispenser 20. This maintenance message may include, but is not limited to an indication on the level of charge left in the dispenser 20 batteries, an estimate on how long the dispenser 20 was out of product 28, or an estimate on the number of users that utilized and did not utilize the dispenser 20 for example. The maintenance message may also transmit a message on the status of other devices in the application, such as the amount of product left in a tissue dispenser or soap dispenser, or the battery charge level in an air freshener for example.

In one embodiment, the controller 56 is a processor-based controller as illustrated in FIG. 6. Controller 56 is a suitable electronic device capable of accepting data and instructions, executing the instructions to process the data, and presenting the results. Controller 56 may accept instructions through user interface, or through other means such as but not limited to electronic data card, voice activation means, manually operable selection and control means, radiated wavelength and electronic or electrical transfer. Therefore, controller 56 can be a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, a cellular computer, a superconducting computer, a supercomputer, a solid-state computer, a single-board computer, a buffered computer, a computer network, a desktop computer, a laptop computer, or a hybrid of any of the foregoing.

Controller 56 is capable of converting the analog voltage or current level provided by proximity sensors 38, 42 into a digital signal indicative of the presence of a user for example. Alternatively, sensors 38, 42 may be configured to provide a digital signal to controller 56, or an analog-to-digital (A/D) converters 68 may be coupled between sensors 38,42 and controller 56 to convert the analog signal provided by sensors 38, 42 into a digital signal for processing by controller 56. Controller 56 uses the digital signals act as input to various processes for controlling the dispenser 20. For example, in response to receiving a signal from the proximity sensor 38, the controller 56 may activate a motor 70 causing a product to be dispensed.

In general, controller 56 accepts data from sensors 38, 42, buttons 50, 52 and activation switch 54 and is given certain instructions for the purpose of carrying out predetermined operational methods and change operational states. For example, controller 56 provides operating signals to motor 70 in response to a user activating the proximity sensor 38 or plays a recorded message in response to the activation of sensor 42.

Controller 56 includes a number of components that are used in carrying out the operational methods. These components include, for example but without limitation, a processor 72 coupled to a random access memory (RAM) device 74, a non-volatile memory (NVM) device 76, a read-only memory (ROM) device 78, and one or more input/output (I/O) controllers 80 via a data communications bus 82.

I/O controllers 80 are coupled to proximity sensors 38, 42 for providing digital data between these devices and bus 82. I/O controllers 80 are also coupled to optional analog-to-digital (A/D) converters 68, which receive analog data signals from proximity sensors 38, 42.

NVM device 76 is any form of non-volatile memory such as an EPROM (Erasable Programmable Read Only Memory) chip, flash memory, magnetic media, optical media, a disk drive, or the like. Stored in NVM device 76 are various operational parameters for the application code. The various operational parameters can be input to NVM device 76, such as a recorded message for example. In some embodiments, the NVM device 76 may be removable (e.g. flash memory) to allow the recording of the message with another device such as a personal computer for example. Further, the NVM device 76 may be arranged to store multiple messages, such as if multiple languages are desired. It should be appreciated that application code can be stored in NVM device 76 rather than ROM device 78.

Controller 56 includes operation control methods embodied in application code depicted in flowchart fashion in FIGS. 9 and 10, discussed in more detail below. These methods are embodied in computer instructions written to be executed by processor 72, typically in the form of software. The software can be encoded in any language, including, but not limited to, assembly language, VHDL (Verilog Hardware Description Language), VHSIC HDL (Very High Speed IC Hardware Description Language), Fortran (formula translation), C, C++, C Sharp, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

Figure 7:
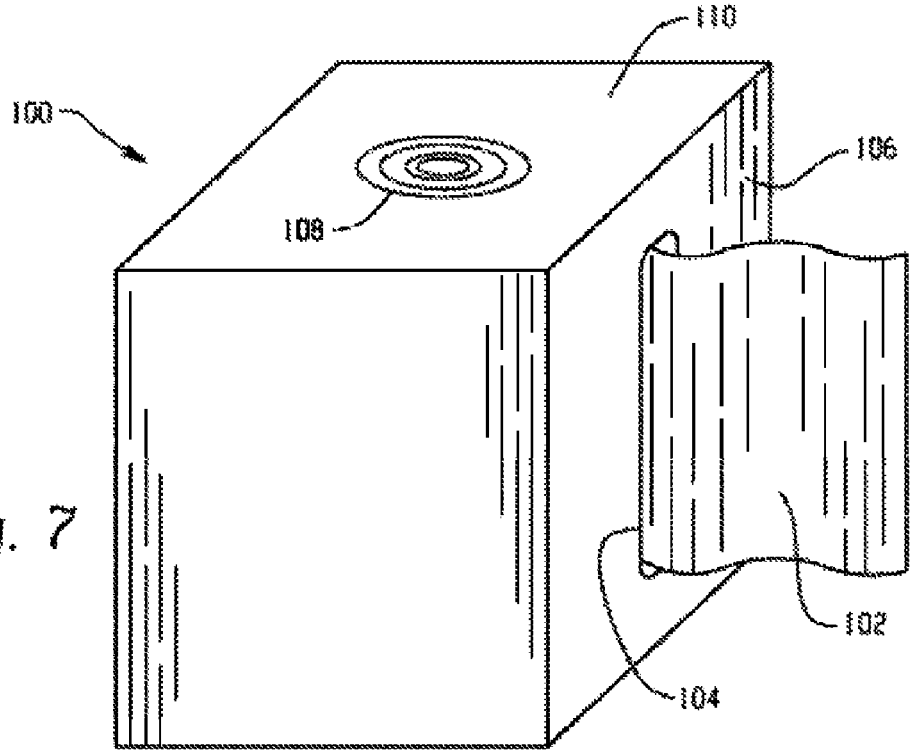
FIG. 7 is a perspective view illustration of another embodiment dispenser.
Figure 8:
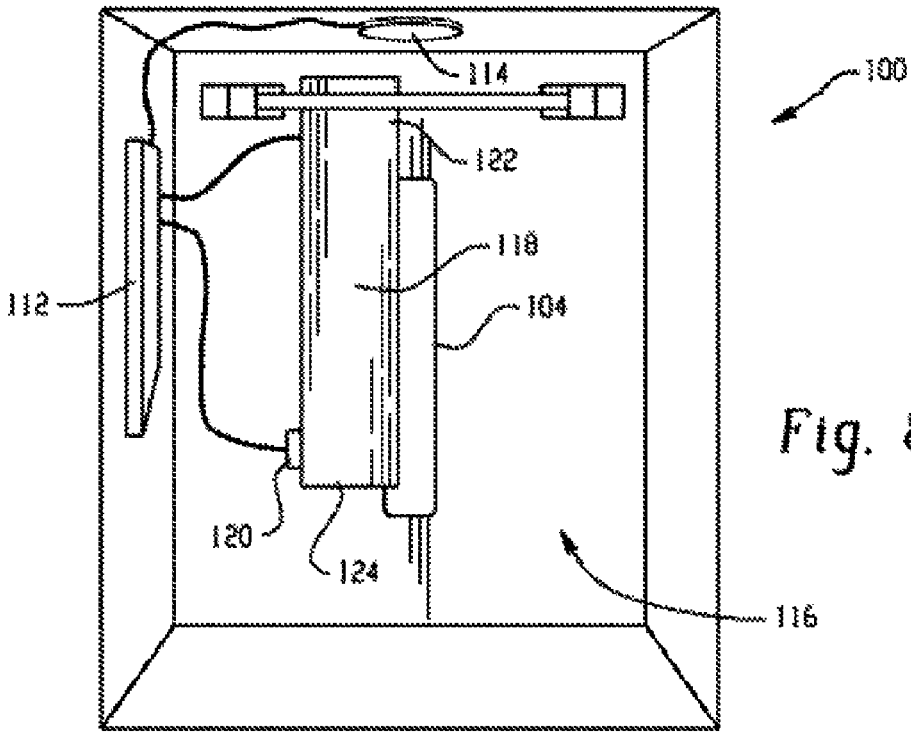
FIG. 8 is a perspective view illustration of the dispenser of FIG. 7 with a cover removed.

Another embodiment of a dispenser 100 is illustrated in FIG. 7 and FIG. 8. In this embodiment, the dispenser 100 includes a supply of product 102, is as tissue or folded paper product for example, that is removed through a slot 104 on a side 106. A slotted opening 108 is formed on a second side 110 to allow a speaker 114 to emit sounds to the user. The dispenser 100 includes a recording module 112 mounted in an interior portion 116. The recording module 112 is electrically coupled to a dispensing plate/lever 118 and an electrical contact 120. The dispensing plate 118 is fixed to the dispenser 100 on one end 122 and a second end 124 free to move into and out of contact with the electrical contact 120, thereby forming a switch device. In one embodiment the dispenser plate 118 is shaped to bias the end 124 away from the contact 120. During operation, when the user pulls product 102 from the dispenser 100, the product 102 applies a force to the dispensing plate 118 causing end 124 to move into contact with the contact 120. This completes an electrical circuit creating a signal to recording module 112 that results in the playing of the recorded message via speaker 114. It should be appreciated that dispenser 100 may also have proximity sensors such as those described above in addition to or in lieu of the dispensing plate.

It should be appreciated that while the embodiments are described herein with reference to an audible recording, the scope of the claimed invention should not be so limited. In some embodiments, the dispenser may have a video screen (not shown) that displays a prerecorded video in response to activation by the proximity sensor 42. In these embodiments, the dispenser may further include a video camera adjacent to the speaker/microphone device 48 to allow the recording of a video message.

Figure 9:
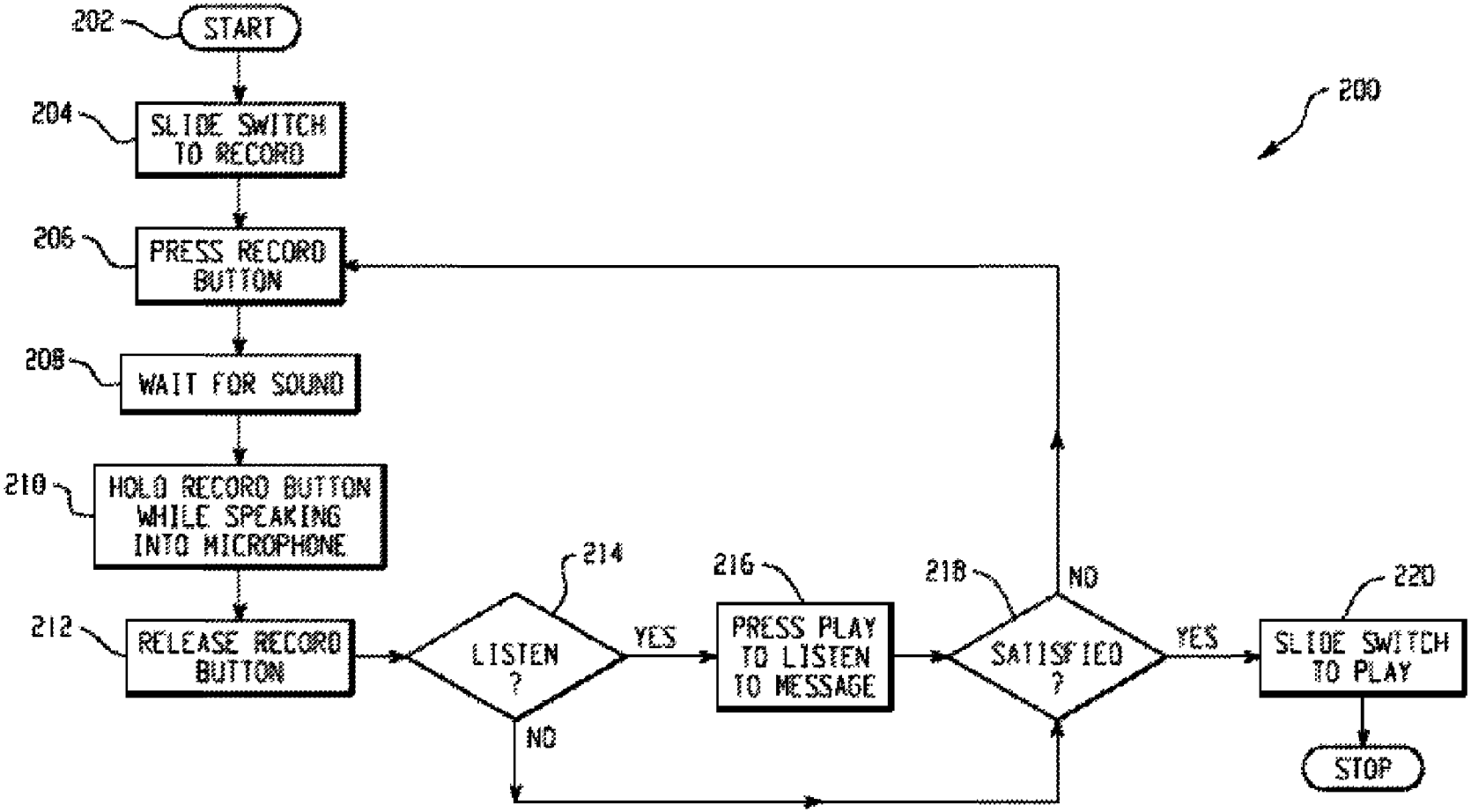
FIG. 9 is a flow chart of a method of recording messages for use with a dispenser with communications ability; and, FIG. 10 is a flow chart of a method of operating a dispenser with communications ability.

Referring now to FIG. 9, a method 200 of programming a dispenser 20 is disclosed. The method 200 starts in block 202 and proceeds to block 204 where a user actuates switch 54 to a record position. The method 200 then proceeds to block 206 where the user actuates a record button 50. In some embodiments, the actuation of the record button 50 requires a small diameter tool, such as a pen for example, to depress the button. The record button 50 is held in the actuated position until a sound, such as a tone or a beep, is emitted through the speaker/microphone device 48 in block 208. While continuing to hold the record button 50 in the actuated position, the user speaks the message they want to record into the speaker/microphone device 48 in block 210. When the user has finished speaking the message, the user releases the record button 50 in block 212.

The user then has the choice of listening to the message they just recorded in query block 214. If query block 214 returns an affirmative, the user presses the play button 52 in block 216. The recorded message is played through the speaker/microphone device 48 and the method 200 proceeds to query block 218. Otherwise, if the query block 214 returns a negative (e.g. they do not want to listen to the message) the method 200 will also proceed to block 218.

If the user is satisfied with the recorded message, the query block 218 returns an affirmative and the method proceeds to block 220 where the user actuates the switch 54 to the play position and the dispenser is ready for operation. If the user is dissatisfied for some reason, the query block 218 returns a negative and the method 200 loops back to block 206 to allow re-recording of the message.

Figure 10:
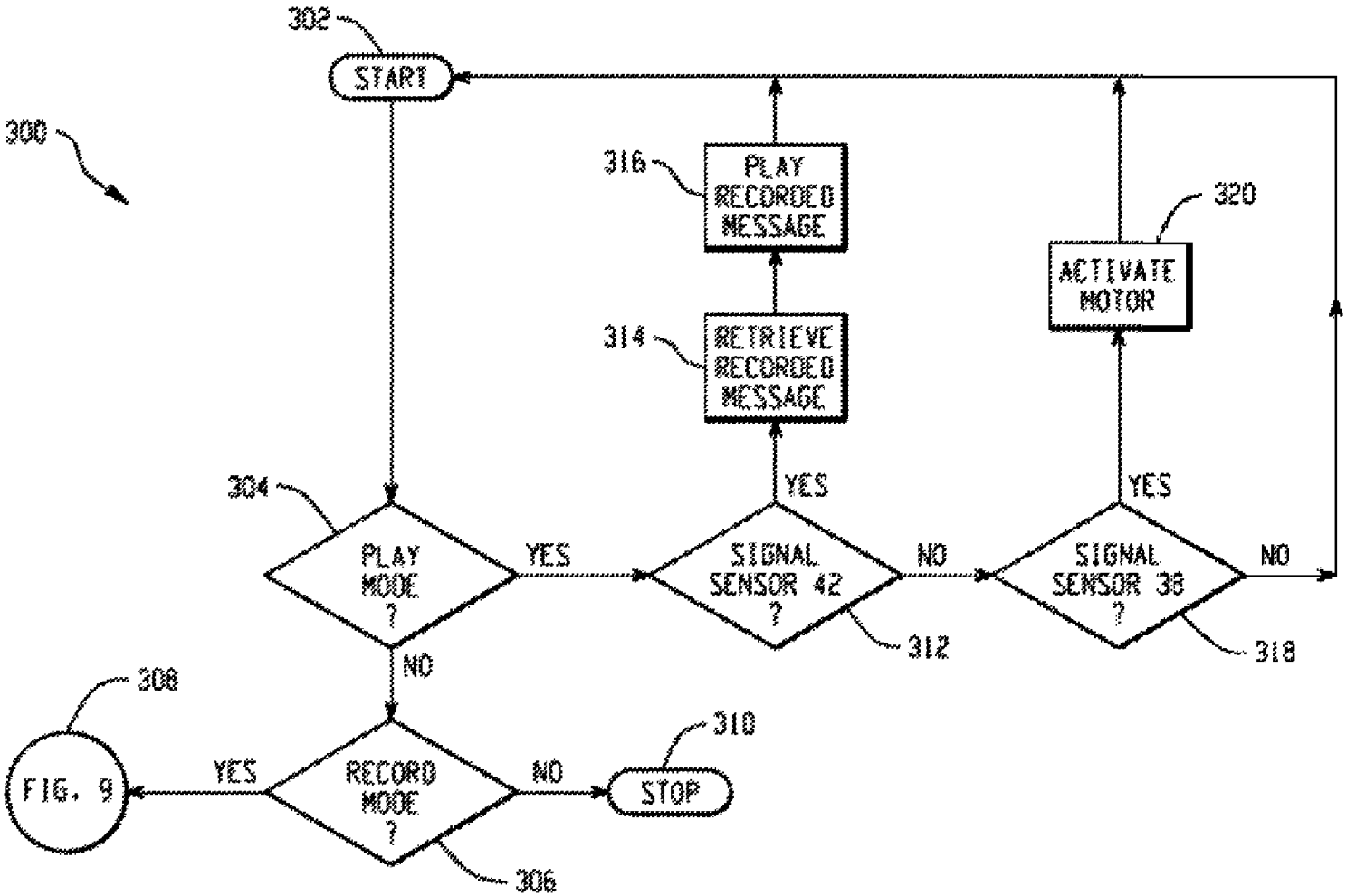

Referring now to FIG. 10, a method 300 of operating dispenser 20 is disclosed. The method 300 starts in block 302 and proceeds to query block 304 where it is determined if the switch 54 is in the "play" position. If the query block 304 returns a negative, the method 300 proceeds to query block 306 where it is determined if the switch 54 is in the "record" position. If query block 306 returns an affirmative, the method 300 terminates and initiates method 200 in block 308. If query block 306 returns a negative, the method 300 terminates in stop block 310.

If query block 304 returns a positive, the method 300 proceeds to block 312 where it is determined if a signal is being received from sensor 42, which would indicate the presence of an object, such as a person for example, within the range of sensor 42. If query block 312 returns a positive, the recorded message is retrieved from NVM device 76 in block 314 and the message is played through speaker/microphone device 48 in block 316. The method 300 then loops back to start block 302 and the process begins again.

If query block 312 returns a negative, the method 300 proceeds to block 318 where it is determined if a signal is being received from sensor 38. In the exemplary embodiment, if a signal is being received from sensor 38, such as when a user is standing in front of and in close proximity to the dispenser 20. If the query block 318 returns a positive, the motor 70 is activated in block 320. Once the motor 70 has been activated, or if the query block 318 returns a negative, the method 300 loops back to start block 302 and the process begins again.

As is apparent from the description of the various embodiments of the present invention, the present disclosure provides numerous advantages. For example, providing dispensers with communication abilities in response to certain triggering events can provide interactive dispensers. In addition, playing a recorded voice message in response to a triggering event enables control of audio emission as a method of preserving electrical power stored in batteries that power a dispenser. Also, the present disclosure provides dispensers having multiple proximity sensors for use in controlling various devices associated with a dispenser. Such devices include dispensing mechanisms and voice play back modules, for example. Other advantageous features include having dispensers with multiple sensors that have different sensing abilities. This feature enables users to selectively control sensing operations and in turn devices controlled by the sensors.

An embodiment of the invention may be embodied in the form of computer-implemented processes and apparatuses for practicing those processes. Embodiments of the present invention may also be embodied in the form of a computer program product having computer program code containing instructions embodied in tangible media, such as floppy diskettes, CD-ROMs, hard drives, USB (universal serial bus) drives, or any other computer readable storage medium, such as random access memory (RAM), read only memory (ROM), or erasable programmable read only memory (EPROM), for example, wherein, when the computer program code is loaded into and executed by a computer, the computer becomes an apparatus for practicing the invention. The embodiments of the invention may also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing the invention. When implemented on a general-purpose microprocessor, the computer program code segments configure the microprocessor to create specific logic circuits. One technical effect of the executable instructions is to transmit a recorded message to a user when a sensor is activated.

The embodiments of the present invention are not limited to the particular formulations, process steps, and materials disclosed herein as such formulations, process steps, and materials may vary somewhat. Moreover, the terminology employed herein is used for the purpose of describing exemplary embodiments only and the terminology is not intended to be limiting since the scope of the various embodiments of the present invention will be limited only by the appended claims and equivalents thereof. Therefore, while certain embodiments of this disclosure have been described in detail with particular reference to exemplary embodiments, those skilled in the art will understand that variations and modifications can be effected within the scope of the disclosure as defined in the appended claims. Accordingly, the scope of the various embodiments of the present invention should not be limited to the above discussed embodiments, and should only be defined by the following claims and all equivalents.

What is claimed is:

1. A dispenser comprising:

a housing having a dispensing area;

a first proximity sensor coupled to said housing adjacent said dispensing area, wherein said first sensor has a first sensin range and is configured to activate in response to a presence of a user's hand;

a dispenser mechanism for dispensing a product from said dispensing area, said dispenser mechanism being operably coupled to said first sensor such that when said first sensor is activated, said dispenser mechanism dispenses said product from said dispensing area;

a second proximity sensor coupled to said housing, wherein said second sensor has a second sensing range and is configured to activate in response to a presence of a user walking by said dispenser, wherein said second sensing range is greater than said first sensing range;

a third sensor operably coupled to activate when said housing is opened; and a speaker operably coupled to said second sensor and to said third sensor, wherein said speaker emits a first prerecorded audible message when said second sensor is activated and a second prerecorded audible message when said third sensor is activated.

2. The dispenser of claim 1 wherein said first sensor activation range is up to 3 inches and said second sensor activation range is up to 6 feet.

3. The dispenser of claim 2 further comprising:

a selection switch operably coupled to said speaker;

a record button operably coupled to said selection switch; and a play button operably coupled to said selection switch and said speaker.

4. The dispenser of claim 3 further comprising a microphone operably coupled to said record button.

5. The dispenser of claim 4 further comprising a controller operably coupled to said record button and said microphone, said controller including a processor that is responsive to executable computer instructions for recording an audio signal from said microphone in response to said record button being actuated.

6. The dispenser of claim 5 wherein said controller includes a memory device operably coupled to said processor, wherein said processor is further responsive to executable computer instructions to store said audio signal on said memory device in response to said record button being actuated.

7. The dispenser of claim 1 wherein said second prerecorded audible message includes a status of said dispenser.

8. The dispenser of claim 7 wherein said second prerecorded audible message indicates a level of charge left in a battery.

9. The dispenser of claim 7 wherein said second prerecorded audible message indicates an estimate on how long said dispenser was out of said product.

10. The dispenser of claim 7 wherein said second prerecorded audible message indicates an estimate on a number of users that utilized said dispenser.

11. The dispenser of claim 1, wherein said second sensing range has a greater sensing area than said first sensing range.

12. The dispenser of claim 1, wherein said first prerecorded audible message is played back in multiple languages when said second sensor is activated.

13. The dispenser of claim 1, wherein said dispenser mechanism is operably coupled to said first sensor independent of said second and said third sensors such that when said first sensor is activated, independent of whether said second and said third sensors are activated, said dispenser mechanism dispenses said product from said dispensing area.

* * * * *